US006508256B2

(12) United States Patent
Byun

(10) Patent No.: US 6,508,256 B2
(45) Date of Patent: Jan. 21, 2003

(54) FOUNDATION-RETAINED COSMETIC IMPLEMENT

(76) Inventor: Young Kwang Byun, MokdongSinsigaji Apt. 928-1005, 312, Shinjung-dong Yangchun-gu, Seoul (KR)

( * ) Notice: Subject to any disclaimer, the term of this patent is extended or adjusted under 35 U.S.C. 154(b) by 0 days.

(21) Appl. No.: 09/850,868

(22) Filed: May 8, 2001

(65) Prior Publication Data

US 2002/0148482 A1 Oct. 17, 2002

(30) Foreign Application Priority Data

Apr. 13, 2001 (KR) ..... 01-19957

(51) Int. Cl.[7] ..... A45D 44/18; A45D 40/24; A45D 40/26

(52) U.S. Cl. ..... 132/313; 132/317; 132/318; 132/320

(58) Field of Search ..... 132/313, 317, 132/318, 316, 314, 320; 401/102, 117

(56) References Cited

U.S. PATENT DOCUMENTS 3,359,991 A * 12/1967 Spatz ..... 132/313
5,289,835 A * 3/1994 Harlan et al. ..... 132/313
5,377,842 A * 1/1995 Sorini ..... 206/581
6,050,271 A * 4/2000 Spencer ..... 132/112
6,234,181 B1 * 5/2001 Lou ..... 132/313

* cited by examiner

*Primary Examiner*—John J. Wilson
*Assistant Examiner*—Robyn Kieu Doan
(74) *Attorney, Agent, or Firm*—Ezra Sutton

(57) ABSTRACT

The present invention relates to a foundation-retained cosmetic implement. The foundation-retained cosmetic implement includes: a body penetrated from the bottom from the top thereof and providing a foundation-receiving space therein; an ejecting valve provided on an upper portion of the body and for adjusting an amount of foundation retained in the body to be ejected and then ejecting the amount of foundation ejected to the outside; a holder provided in parallel to the ejecting valve on the upper portion of the body and having foundation make-up means; an ascending and descending guide part for coupling the ejecting valve and the holder with the upper portion of the body for ascending and descending the ejecting valve and the holder in relative relation to each other; a protecting cap attachably and detachably coupled with the upper portion of the ascending and descending guide part for protecting the foundation paining means from the outside; and a pressurization pump coupled with a lower portion of the body and carrying out an air pumping for injecting the foundation retained in the body to the ejecting valve. Therefore, the foundation can be kept and carried in a simple manner without having a separate cosmetic implement. In addition, a foundation-retained cosmetic implement according to the present invention is capable of adjusting an amount of foundation ejected, whereby an unnecessary consumption of the foundation can be prevented.

13 Claims, 12 Drawing Sheets

FOUNDATION-RETAINED COSMETIC IMPLEMENT

BACKGROUND OF THE INVENTION

1. Field of the Invention

The present invention relates to a foundation-retained cosmetic implement and more particularly, to a foundation-retained cosmetic implement that is integral with a liquid type foundation to be thereby compact in size, whereby the liquid type foundation is easily painted on a user's skin, without requiring a separate cosmetic implement.

2. Description of the Related Art

A foundation used for color make-up is generally classified into a liquid type foundation and a powder type foundation. As widely known, the liquid type foundation is light and soft like lotion and exhibits a high covering power against skin and contrarily, the powder type foundation is adequate to those who have an oily skin.

Of course, as another type of foundation, there is a two-way foundation that takes advantages from the both types of foundation as have been discussed above.

Meanwhile, since the liquid type foundation is in a liquid state, it is generally retained in an elastic container so that a user should squeeze the container to use the foundation. But, the powder type foundation is in a powder state having a predetermined viscosity, thereby it is retained in a separate container or case. And, the two-way foundation is in a solid-like state, thereby it is retained in a similar manner to that of the powder type foundation.

Generally, a cosmetic implement used for make-up on the user's skin, such as the foundation, is a brush or sponge. When carried with the user, the cosmetic implement is separated from the foundation or retained in a foundation containing case.

Here, the powder type foundation and the two-way type foundation are retained in one containing case with the brush or sponge. But, it is difficult to retain the liquid type foundation, which is in a liquid state, in one containing case by furnishing respective area for receiving the foundation together with the brush or sponge, thereby the brush or sponge should be provided with a separate area.

In addition, in case of the liquid type foundation that is retained in the elastic container, it should be squeezed in use and in case of it that is retained in a non-elastic container, it should be shaken and flow through a substantially narrow outlet. In this way, it is somewhat difficult to use an appropriate amount of foundation, which results in an unnecessary consumption of the foundation.

Generally, even a very small amount of the liquid type foundation may make the skin tone undesirably dark and therefore, it is very important to adjust the appropriate amount of foundation from the container for the make-up.

SUMMARY OF THE INVENTION

It is an object of the present invention to provide a foundation-retained cosmetic implement that is integral with a liquid type foundation and is compact in size as a single product, such that it does not need any separate cosmetic implement for make-up the liquid type foundation.

It is another object of the present invention to provide a foundation-retained cosmetic implement that is capable of appropriately adjusting the amount of the foundation for use.

To accomplish these objects of the present invention, there is provided a foundation-retained cosmetic implement including: a body penetrated from the bottom from the top thereof and providing a foundation-receiving space therein; an ejecting valve provided on an upper portion of the body and for adjusting an amount of foundation retained in the body for ejecting and then ejecting the amount of foundation to the outside; a holder provided in parallel to the ejecting valve on the upper portion of the body and having foundation make-up means; an ascending and descending guide part for coupling the ejecting valve and the holder with the upper portion of the body in order to ascend and descend the ejecting valve and the holder relatively to each other; a protecting cap attachably and detachably coupled with the upper portion of the ascending and descending guide part for protecting the foundation make-up means from the outside; and a pressurization pump coupled with a lower portion of the body and carrying out an air pumping for injecting the foundation retained in the body to the ejecting valve.

The ejecting valve is ascendably and descendably disposed on the upper portion of the body, the ascending and descending guide part is adapted to surround the outer periphery of the ejecting valve and rotatably disposed on the upper portion of the body, such that the ejecting valve is ascended and descended as the ascending and descending guide part is forced to rotate with forward and return motion, and the holder is fixedly disposed on the one side of the ascending and descending guide part.

In this way, in a preferred embodiment of the present invention, the ejecting valve includes: a sleeve forming a protrusion on the outer periphery thereof and a pipe path penetrating the both sides thereof through which the foundation is passed on the center thereof; a ball adapted to be inserted into the pipe path of the sleeve and rotated while contacted with the one side of the sleeve; a support part adapted to be inserted into the pipe path of the sleeve for supporting the ball on the one side thereof and forming a pipe path penetrating the one side thereof that communicates with the pipe path of the sleeve on the center thereof and a hole communicating with the pipe path thereof on the outer periphery thereof; a spring positioned on the one side of the support part and interposed in the pipe path of the sleeve; a movable valve pipe disposed on the one side of the spring to be inserted into the pipe path of the sleeve and forming a pipe path penetrating the one side thereof that communicates with the pipe path of the support part through the hole of the support part on the center thereof and a hole communicating with the pipe path thereof on the outer periphery thereof; a fixed valve pipe disposed on the one side of the movable valve pipe and forming a pipe path penetrating the one side thereof that communicates with the pipe path of the movable valve pipe through the hole of the movable valve pipe on the center thereof and a hole communicating with the pipe path thereof on the outer periphery thereof, thereby functioning to finally communicate between the body and the sleeve; and a valve coupler for coupling the fixed valve pipe to the upper portion of the body and forming a coupling groove and an ascending and descending groove on the outer peripheral surface thereof, the ascending and descending groove into which the protrusion of the sleeve is inserted, such that an ascending and descending driving direction is guided for the sleeve, the ascending and descending guide part is provided with a coupling projection that is engaged with the coupling groove, with a result that it rotates on the outer side of the valve coupler and with a spiral groove into which the protrusion of the sleeve is inserted, with a result that the sleeve receives the ascending and descending driving force through the protrusion, and the holder is provided on the one side of the ascending and descending guide part and penetrates the center thereof, through which the sleeve is ascendable and descendable.

In another preferred embodiment of the present invention, the ejecting valve further includes: a sleeve forming a protrusion on the outer periphery thereof and a pipe path penetrating the both sides thereof through which the foundation is passed on the center thereof; an ejecting brush adapted to be inserted into the pipe path of the sleeve and secured, while being contacted with the one side of the sleeve; an ejecting brush holder adapted to be inserted into the pipe path of the sleeve for supporting the ejecting brush on the one side thereof and forming a hole communicating with the pipe path of the sleeve on the center thereof; a movable valve pipe disposed on the one side of the ejecting brush holder to be inserted into the pipe path of the sleeve and forming a pipe path penetrating the one side thereof that communicates with the hole of the ejecting brush holder on the center thereof; a fixed valve pipe disposed on the one side of the movable valve pipe and forming a pipe path penetrating the one side thereof that communicates with the pipe path of the movable valve pipe through the hole of the movable valve pipe on the center thereof and a hole communicating with the pipe path thereof on the outer periphery thereof, thereby functioning to finally communicate between the body and the sleeve; and a valve coupler for coupling the fixed valve pipe to the upper portion of the body and forming a coupling groove and an ascending and descending groove on the outer peripheral surface thereof, the ascending and descending groove into which the protrusion of the sleeve is inserted, such that an ascending and descending driving direction is guided for the sleeve, the ascending and descending guide part is provided with a coupling projection that is engaged with the coupling groove, with a result that it rotates on the outer side of the valve coupler and with a spiral groove into which the protrusion of the sleeve is inserted, with a result that the sleeve receives the ascending and descending driving force through the protrusion, and the holder is provided on the one side of the ascending and descending guide part and penetrates the center thereof, through which the sleeve is ascendable and descendable.

Preferably, the movable valve pipe interposes a spring and a switch part in the pipe path thereof, in order to eject the foundation only in one direction.

In still another preferred embodiment of the present invention, on the other hand, the ejecting valve is secured to the upper portion of the body, the holder is disposed in manner to be ascendable on the upper portion of the body, and the ascending and descending guide part is provided in manner to surround the outer periphery of the holder and rotate on the upper portion of the body, with a consequence that the holder is ascended and descended, as it rotates with forward and return motion.

At this time, the ejecting valve further includes: a sleeve forming a protrusion and a coupling groove on the outer periphery thereof and a pipe path penetrating the both sides thereof through which the foundation is passed on the center thereof and coupled to the upper portion of the body; a ball adapted to be inserted into the pipe path of the sleeve and secured, while being contacted with the one side of the sleeve; a support part adapted to be inserted into the pipe path of the sleeve for supporting the ball on the one side thereof and forming a pipe path penetrating the one side thereof that communicates with the pipe path of the sleeve on the center thereof and a hole communicating with the pipe path thereof on the outer periphery thereof; a spring disposed on the one side of the holder and interposed in the pipe path of the sleeve; and a fixed valve pipe disposed on the one side of the spring to be inserted into the pipe path of the sleeve and forming a pipe path penetrating the one side thereof that communicates with the pipe path of the support part through the hole of the support part on the center thereof and a hole communicating with the pipe path thereof on the outer periphery thereof, thereby functioning to finally communicate between the body and the sleeve, the holder is extended on the one side thereof, penetrates the center thereof, forms an ascending and descending projection on the outer periphery thereof and forms a spiral groove into which the protrusion is inserted on the inner periphery thereof, such that the holder receives its ascending and descending driving force from the protrusion, and the ascending and descending guide part is provided with a coupling projection that is engaged with the coupling groove, with a result that it rotates on the outer side of the sleeve and with an ascending and descending groove into which the ascending and descending projection of the holder is inserted, with a result that an ascending and descending driving direction is guided onto the holder.

In still another preferred embodiment of the present invention, the ejecting valve further includes: a sleeve forming a protrusion on the outer periphery thereof and a pipe path penetrating the both sides thereof through which the foundation is passed on the center thereof and coupled to the upper portion of the body; an ejecting brush adapted to be inserted into the pipe path of the sleeve and secured, while being contacted with the one side of the sleeve; an ejecting brush holder adapted to be inserted into the pipe path of the sleeve for supporting the ejecting brush on the one side thereof and forming a hole communicating with the pipe path of the sleeve on the center thereof, and a fixed valve pipe disposed on the one side of the ejecting brush holder to be inserted into the pipe path of the sleeve and forming a pipe path penetrating the one side thereof that communicates with the hole of the ejecting brush holder on the center thereof and a hole communicating with the pipe path thereof on the outer periphery thereof, thereby functioning to finally communicate between the body and the sleeve, the holder is extended on the one side thereof, penetrates the center thereof, forms an ascending and descending projection on the outer periphery thereof and forms a spiral groove into which the protrusion is inserted on the inner periphery thereof, such that the holder receives its ascending and descending driving force from the protrusion. And, the ascending and descending guide part is provided with a coupling projection that is engaged with the coupling groove, with a result that it rotates on the outer side of the sleeve and with an ascending and descending groove into which the ascending and descending projection of the holder is inserted, with a result that an ascending and descending driving direction is guided onto the holder.

Preferably, the fixed valve pipe interposes a spring and a switch part in the pipe path thereof, in order to eject the foundation only in one direction.

On the other hand, the pressurization valve includes: an air valve pipe providing a path through which air passes; an air tube coupled to the one end of the air valve pipe for guiding an air pouring direction to the ejecting valve; a spring interposed in the center of the air tube; a switch part inserted in the center of the air tube and for injecting air in one direction by virtue of an elastic force of the spring; a rear cap coupled to the other end of the air valve pipe and forming a closed space on the center thereof, a compressive part for reciprocating movement in the closed space of the rear cap to pour the compressed air to the air valve pipe; a button coupled to the compressive part and exposed to the outside through the rear cap on the one side thereof to apply a reciprocating driving force to the compressive part by an external power; and a spring interposed between the air valve pipe and the compressive part for providing a restoring strength in one direction to the compressive part.

Preferably, the foundation make-up means should be a brush or sponge.

DETAILED DESCRIPTION OF THE PREFERRED EMBODIMENTS

Figure 1:
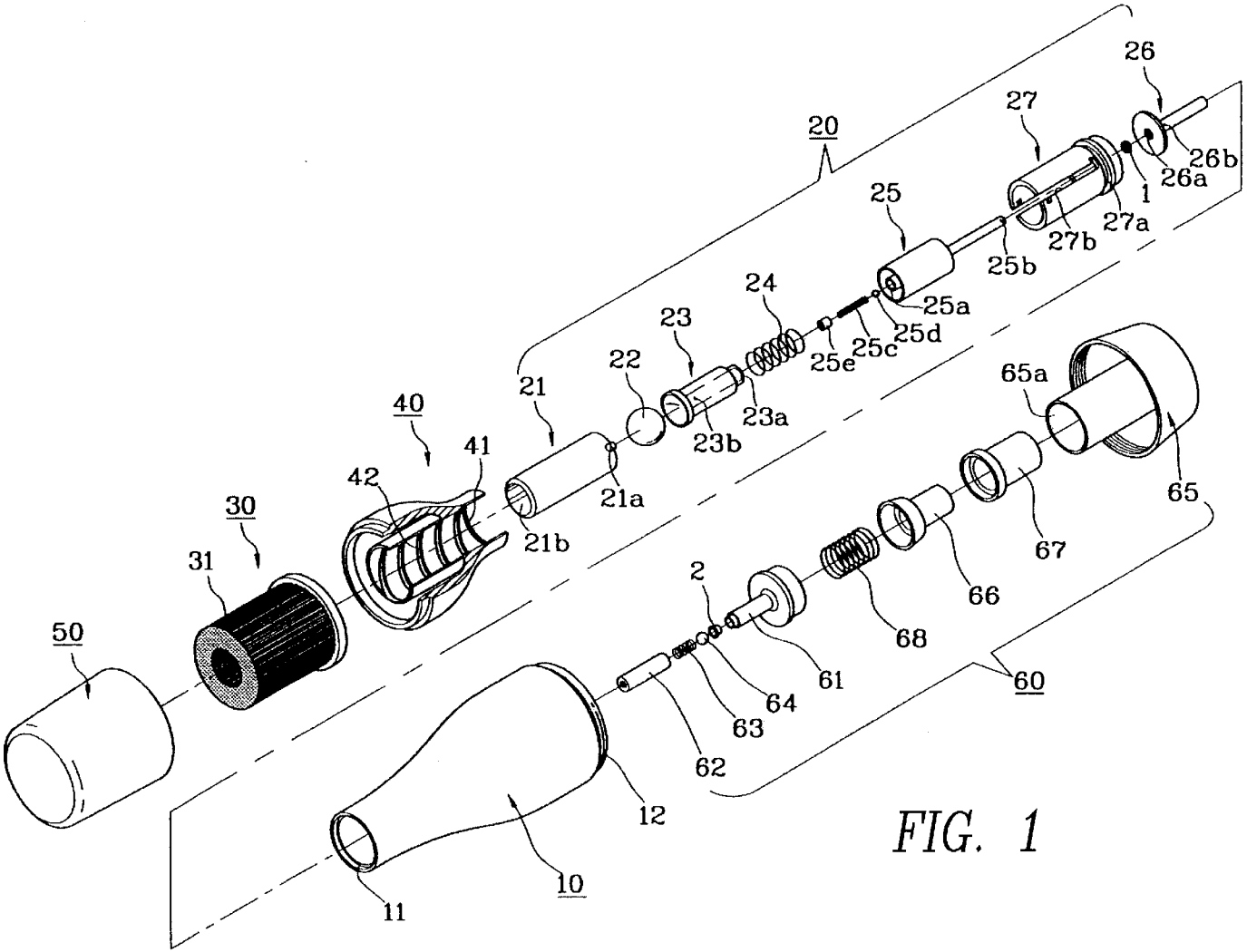
FIG. 1 is an exploded perspective view partly cut away of a first embodiment of the foundation-retained cosmetic implement of the present invention.

The preferred embodiments of the present invention will be in detail discussed with reference to the accompanying drawings.

A foundation-retained cosmetic implement includes a body 10 providing a foundation-receiving space therein, an ejecting valve 20 for ejecting an appropriate amount of foundation retained in the body 10, a holder 30 on which foundation make-up means is provided, an ascending and descending guide part 40 for ascending and descending the ejecting valve 20 and the holder 30 in relative relation to each other on the basis of the body 10, a protecting cap 50 for protecting the foundation paining equipment provided on the holder 30 from the outside, and a pressurization pump 60 for injecting the foundation retained in the body 10 to the ejecting valve 20.

The present invention can make various preferred embodiments in accordance with the driving manner to ascend and descend the ejecting valve 20 and the holder 30 in relative relation to each other. Therefore, a first embodiment where the holder 30 is secured and the ejecting valve 20 is ascendably and descendably driven and a second embodiment where the ejecting valve 20 is secured and the holder 30 is ascendably and descendably driven are followed in detail hereinafter.

Of course, the technical scope of the present invention is not limited only to the first and second embodiments of the present invention.

Figure 2:
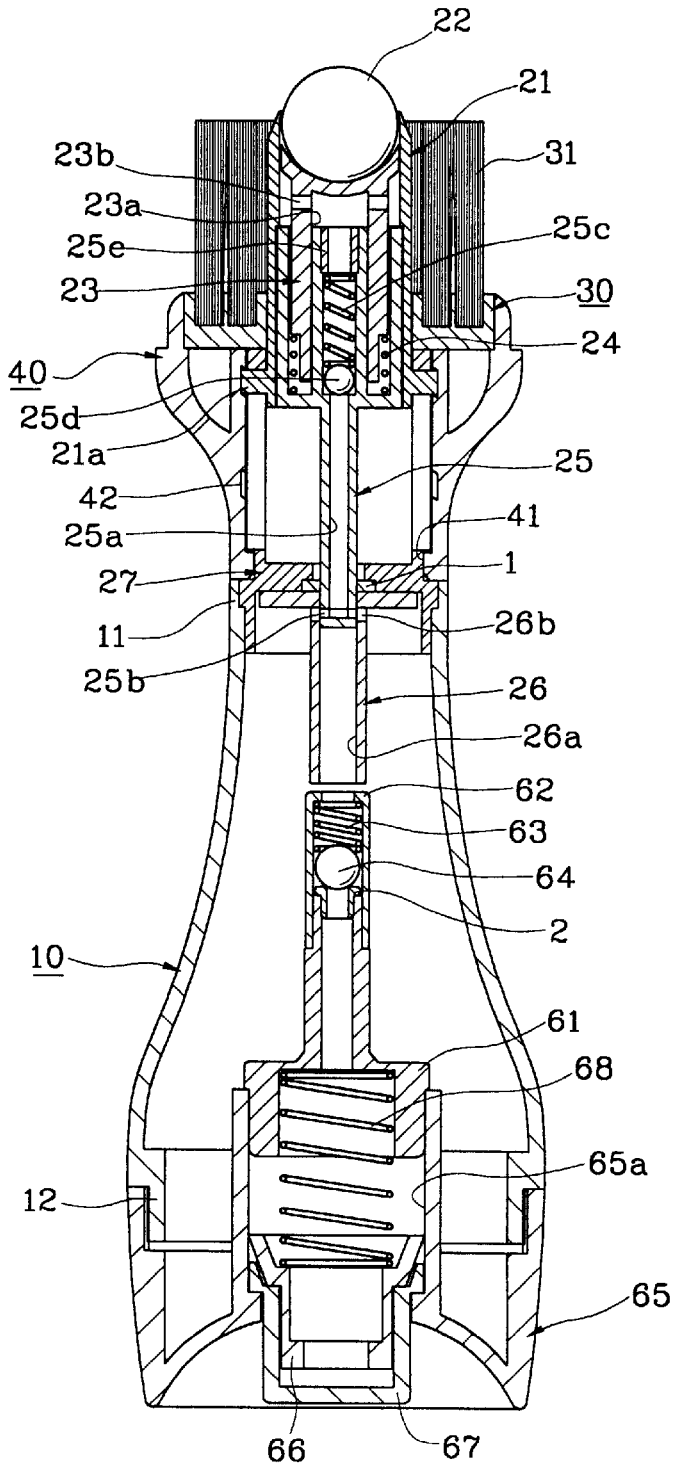
FIG. 2 is a sectional view illustrating the state where a ball is ascended in FIG. 1.
Figure 3:
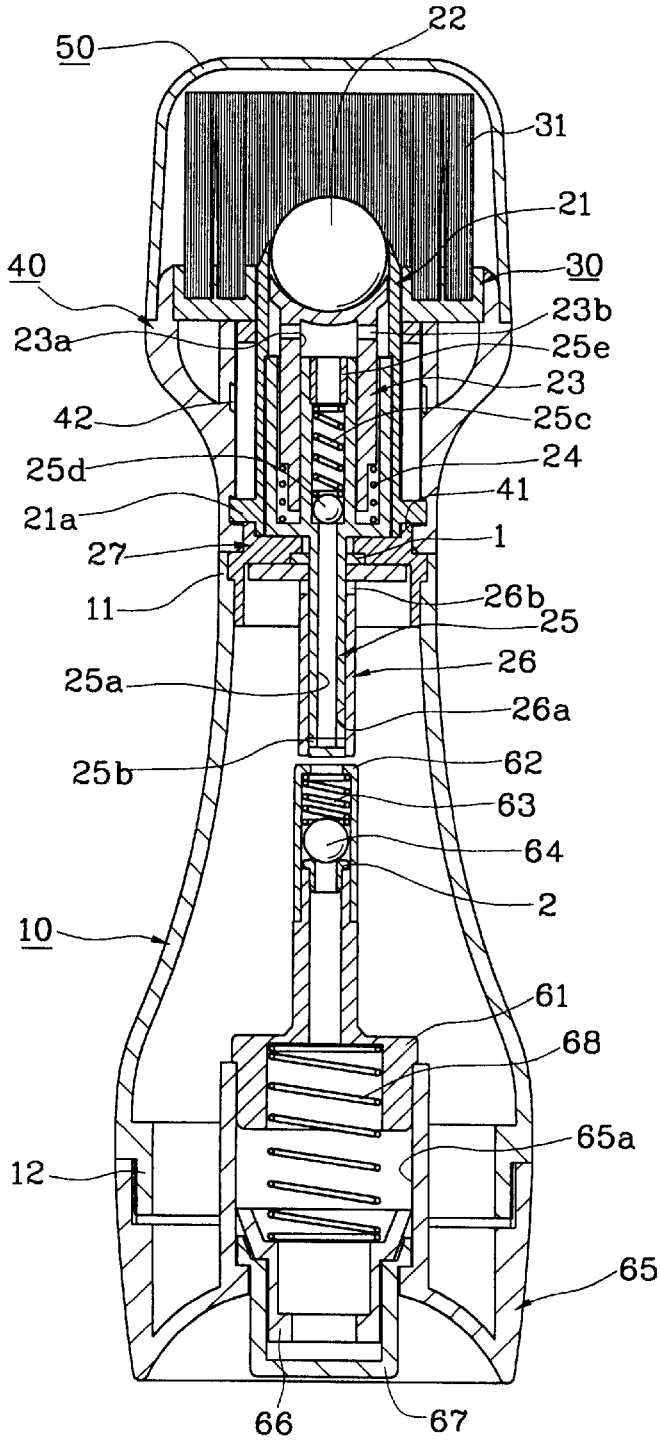
FIG. 3 is a sectional view illustrating the state where a ball is descended in FIG. 1.

FIG. 1 is an exploded perspective view partly cut away of a first embodiment of the foundation-retained cosmetic implement of the present invention, FIG. 2 is a sectional view illustrating the state where a ball is ascended in FIG. 1, and FIG. 3 is a sectional view illustrating the state where a ball is descended in FIG. 1.

According to the first embodiment of the present invention, the foundation-retained cosmetic implement, wherein the holder 30 with foundation make-up means is secured at a predetermined position and the ejecting valve 20 is ascendably and descendably driven, includes the body 10 providing a foundation-receiving space therein, the ejecting valve 20 disposed on an upper portion 11 of the body 10 and ascendably and descendably driven, an ascending and descending guide part 40 for guiding the ascending and descending of the ejecting valve 20 by an external force; the holder 30 disposed on the one side of the ascending and descending guide part 40 and for maintaining its motion-stop state at a predetermined position, the protecting cap 50 for protecting the foundation paining means provided on the holder 30 from the outside, and the pressurization pump 60 for injecting the foundation retained in the body 10 to the ejecting valve 20.

The body 10 penetrates the upper portion 11 and the lower portion 12 thereof, into which the foundation is retained.

The ejecting valve 20, which is adapted to eject the foundation retained in the body 10 under an appropriate adjustment for the amount of foundation, includes a sleeve 21, a ball 22, a support part 23, a spring 24, a movable valve pipe 25, a fixed valve pipe 25 and a valve coupler 27.

The sleeve 21, which is adapted to be exposed to the outside, in the state where it receives the ball 22 for ejecting an appropriate amount of foundation in accordance with the rotation of the ball 22 in the sleeve 21, is provided with a protrusion 21*a* on the outer periphery thereof and a pipe path 21*b* penetrating the both sides thereof on the center thereof, through which the foundation is passed.

The ball 22, which is adapted to be inserted into the pipe path 21*b* of the sleeve 21 and rotated, while being contacted with the one side of the sleeve 21. Of course, the one side with which the ball 22 of the sleeve 21 is contacted should take such a predetermined shape that the ball 22 is not deviated to the outside. Such the sleeve 21 is provided to eject an appropriate amount of foundation in accordance with the rotation of the ball 22, which is similar to, for example, a ball pen from which ink is appropriately ejected in accordance with the rotation of the ball.

The support part 23, which is adapted to be inserted into the pipe path 21*b* of the sleeve 21 for supporting the rotation of the ball 22 in the state where the ball 22 has been closely contacted onto the one side of the sleeve 21, forms a pipe path 23*a* penetrating the one side thereof that communicates with the pipe path 21*b* of the sleeve 21 on the center thereof and a hole 23*b* communicating with the pipe path 23*a* thereof on the outer periphery thereof.

The spring 24, which supplies an elastic force to the support part 23 to permit the ball 22 to be closely contacted with the one side of the sleeve 21, is interposed in the pipe path 21*b* of the sleeve 21, while being positioned on the one side of the support part 23.

The movable valve pipe 25, which is finally inserted into the pipe path 21*b* of the sleeve 21, functions to prevent the whole components inserted into the pipe path 21*b* of the sleeve 21, that is, the ball 22, the support part 23 and the spring 24 from being deviated in the state where they are inserted into the sleeve 21 and functions as a connecting path such that the foundation retained in the body 10 reaches the ball 22. The movable valve pipe 25 forms a pipe path 25*a* penetrating the one side thereof on the center thereof and a hole 25*b* communicating with the pipe path 25*a* thereof on the outer periphery thereof.

The fixed valve pipe 26 is disposed on the upper portion 11 of the body 10 and communicates with the pipe path 25*a* of the movable valve pipe 25, such that when the sleeve 21 is ascended and reaches a maximum ascending point, the foundation retained in the body 10 reaches the position of the ball 22. The fixed valve pipe 26 forms a pipe path 26*a* penetrating the one side thereof that communicates with the pipe path 25*a* of the movable valve pipe 25 through the hole 25*b* of the movable valve pipe 25 on the center thereof and a hole 26*b* communicating with the pipe path 26*a* thereof on the outer periphery thereof.

In FIG. 2, the movable valve pipe 25 is ascended as the sleeve 21 is ascended. At this time, the hole 25*b* of the movable valve pipe 25 comes in contact with the hole 26*b* of the fixed valve pipe 26. In FIG. 3, when the sleeve 21 is descended, the hole 25*b* of the movable valve pipe 25 is mismatched with the hole 26*b* of the fixed valve pipe 26, such that the respective holes are blocked.

This is intended to eject the foundation to the outside, when the sleeve 21 is ascended up to top. It can be, of course, understood that there is a predetermined gap between the movable valve pipe 25 and the fixed valve pipe 26, such that the foundation can be ejected to the outside in more easy manner, at the time when they should be accurately matched with each other.

The foundation retained in the body 10 reaches the position of the ball 22, via the hole 26*b* and pipe path 26*a* of the fixed valve pipe 26, the hole 25*b* and pipe path 25*a* of the movable valve pipe 25 and the pipe path 23*a* and hole 23*b* of the support part 23, at a starting point of the body 10.

Such the foundation-ejecting path enables an appropriate amount of the foundation to be ejected to the outside. More preferably, the movable valve pipe 25 interposes a spring 25*c* and a switch part 25*d* therein, for the purpose of preventing the foundation retained in the body 10 from being unnecessarily ejected.

In more detail, the spring 25*c* and the switch part 25*d* are interposed in the pipe path 25*a* of the movable valve pipe 25, with a consequence that the foundation is ejected only in one direction. The spring 25*c* and the switch part 25*d* are interposed in the movable valve pipe 25 by means of a spring holder 25*e*, without any deviation from the pipe path 25*a*. Thus, the foundation flowing by the air pouring action of the pressurization pump 60 as will be discussed later is forced to pressurize the switch part 25*d* under a predetermined pressure and is then passed through the pipe path 25*a* of the movable valve pipe 25. In case where the pressure of the foundation caused by the pressurization pump 60 is not applied, the switch part 25*d* blocks the pipe path 25*a* of the movable valve pipe 25 by the elastically restoring strength of the spring 25*c*, thereby preventing the foundation from being unnecessarily ejected to the outside.

The valve coupler 27, which serves to couple the fixed valve pipe 26 to the body 10 and come in contact with the sleeve 21 to guide the ascending and descending driving direction of the sleeve 21, forms a coupling groove 27a into which the ascending and descending guide part 40 as will be discussed below is rotatably coupled and an ascending and descending groove 27*b* into which the protrusion 21*a* of the sleeve 21 is inserted, on the outer peripheral surface thereof.

As the protrusion 21 of the sleeve 21 is inserted into the ascending and descending groove 27*b* of the valve coupler 27, as a consequence, the sleeve 21 is driven along the guide direction of the ascending and descending groove 27*b* of the valve coupler 27.

Thereafter, the ascending and descending guide part 40, which is adapted to drive the sleeve 21 into which the ball 22 is inserted under the external force, forms a coupling projection 41 which is inserted into the coupling groove 27*a* of the valve coupler 27 and a spiral groove 42 into which the protrusion 21*a* of the sleeve 21 is inserted.

In other words, the ascending and descending guide part 40 is rotatably coupled to the coupling groove 27*a* of the valve coupler 27 into which the coupling projection 41 is inserted and if it is rotated in the state where the spiral groove 42 is engaged with the protrusion 21*a* of the sleeve 21, the protrusion 21*a* moves along the spiral groove 42 under the guide direction of the ascending and descending groove 27*b*. Therefore, the rotating force of the ascending and descending guide part 40 serves as a motive power for driving the sleeve 21.

The holder 30, which is adapted to form the foundation make-up means as an integral body with the body 10, is fixedly provided on the one side of the ascending and descending guide part 40.

Figure 4:
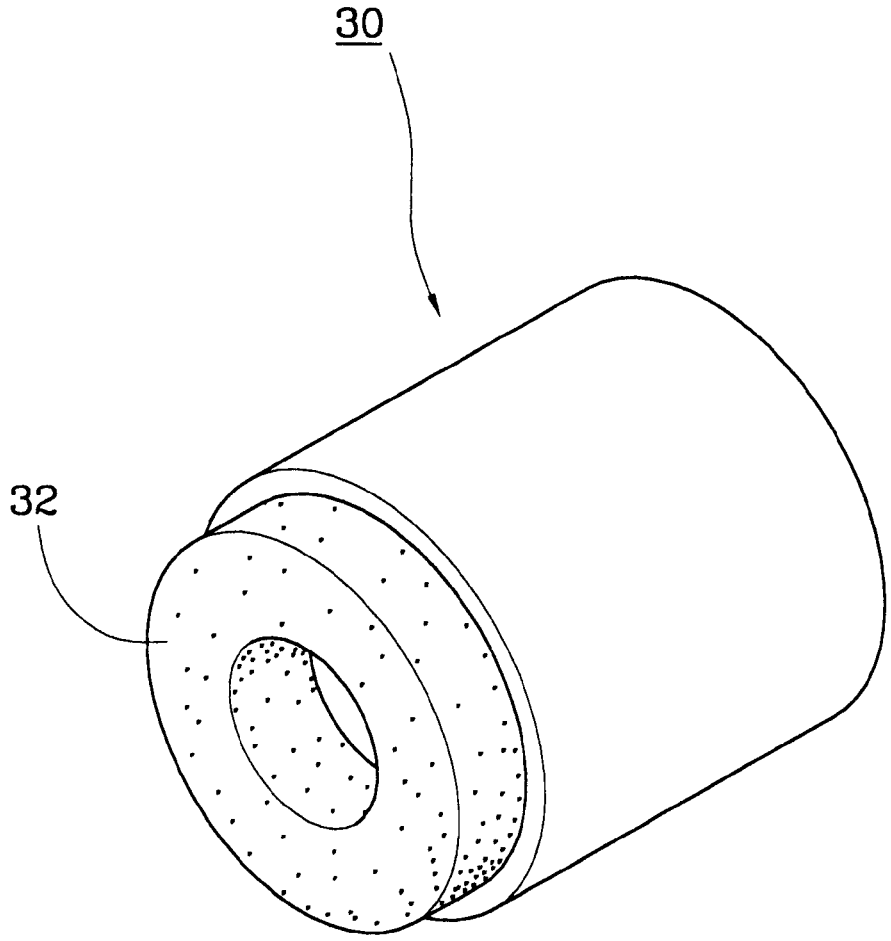
FIG. 4 is a perspective view illustrating another embodiment of the holder in FIG. 1.

The foundation make-up means provided on the holder 30 is a brush 31 made of soft fibers as shown in FIG. 1 or sponge 32 as shown in FIG. 4.

The protecting cap 50, which is adapted to protect the foundation make-up means from the outside, is attachably and detachably coupled on the top of the ascending and descending guide part 40.

Hereinafter, a most preferred embodiment of the pressurization pump 60 according to the present invention will be discussed.

The pressurization pump 60, which is adapted to induce the foundation retained in the body 10 to the ejecting valve 20 in an air-pouring manner, includes an air valve pipe 61, an air tube 62, a spring 63, a switch part 64, a rear cap 65, a compressive part 66, a button 67 and a spring 68.

The air valve pipe 61 and the air tube 62 are provided to inject compressed air in a predetermined direction.

In more detail, the air valve pipe 61 is coupled to the rear cap 65 at the one end thereof to thereby form a closed space 65*a* on the center of the rear cap 65 and coupled to the air tube 63 at the other end thereof to thereby guide a direction to be injected of the compressed air, such that the foundation retained in the body 10 is injected to the direction of the ejecting valve 20.

At this time, so as to prevent the foundation from flowing to the closed space 65*a* there are provided the spring 63 and the switch part 64 between the air valve pipe 61 and the air tube 62. If the air within the closed space 65*a* is compressed by virtue of the pressurization of the button 67 as will be discussed later, the switch part 64 which has blocked the one end of the air valve pipe 61 is deviated, such that there is formed a predetermined interval between the air valve pipe 61 and the air tube 62, from which the compressed air is injected. To the contrary, if the button 67 is restored by the elastic force of the spring 68, the switch part 64 blocks the one end of the air valve pipe 61 again by the elastic force of the spring 68, such that the foundation retained in the body 10 does not flow to the closed space 65*a*.

As a result, the air tube 62, which is adapted to guide the injection direction of the compressed air, may be formed as an integral body with the air valve pipe 61 but if the spring 63 and the switch part 64 are to be interposed in the air valve pipe 61, the air tube 62 should be formed as a separate body from the air valve pipe 61. This is preferable from the viewpoint of the convenience of the manufacturing.

The rear cap 65 is adapted to couple the whole components contained in the pressurization pump 60 such as, for example, the air valve pipe 61, the air tube 62, the compressive part 66 and the button 67 to the lower portion 12 of the body 10 and to provide the closed space 65*a* where the air is compressed. The rear cap 65 is coupled to the other end of the air valve pipe 61 preferably in a forced pressurization manner or more preferably in a screw-coupling manner and provides the closed space 65*a* where the air is compressed according to the coupling with the air valve pipe 61, on the center thereof.

The compressive part 66 and the button 67 are adapted to compress the air within the closed space 65*a* to thereby inject the compressed air to the air valve pipe 61 and the air tube 62. They are inserted into the closed space 65*a* of the rear end thereof, while being coupled to each other.

The compressive part 66 is provided with the spring 68 on the one side thereof and therefore, if the compressive part 66 that has been closely contacted with the outer periphery of the closed space 65*a* moves by the application of the pressurization force to the button 67 from the external force, the compressed air is momentarily injected. Contrarily, if the external force applied against the button 67 is removed thereafter, the compressive part 66 and the button 67 are restored to their original positions by the elastic force of the spring 68.

According to the first embodiment of the present invention, the ball 22 of the ejecting valve 20 can be ascended and descended relative to the holder 30 by the application of the external rotating force to the ascending and descending guide part 40. Upon make-up with the foundation, therefore, the ascending and descending guide part 40 is rotated to ascend the ball 22 up to the top and then, the ball 22 rolls on the skin to be painted, such that the foundation is ejected on the corresponding skin. When an appropriate amount of foundation is ejected, the ascending and descending guide part 40 is rotated with reverse movement to descend the ball 22 up to the bottom and subsequent to this, the foundation is evenly covered with the skin by using the foundation make-up means (31 or 32) provided on the holder 30.

Ejecting the appropriate amount of foundation is allowed when the body 10 is swung or turns upside down but preferably with the action of the pressurization pump 60. As discussed above, the pressurization pump 60 injects the foundation with the compressed air by the guide of the air tube 62 adjacent to the fixed valve pipe 26 of the ejecting valve 20. The pumping action of the pressurization pump 60 enables the adjustment of the appropriate amount of foundation to be ejected.

Figure 5:
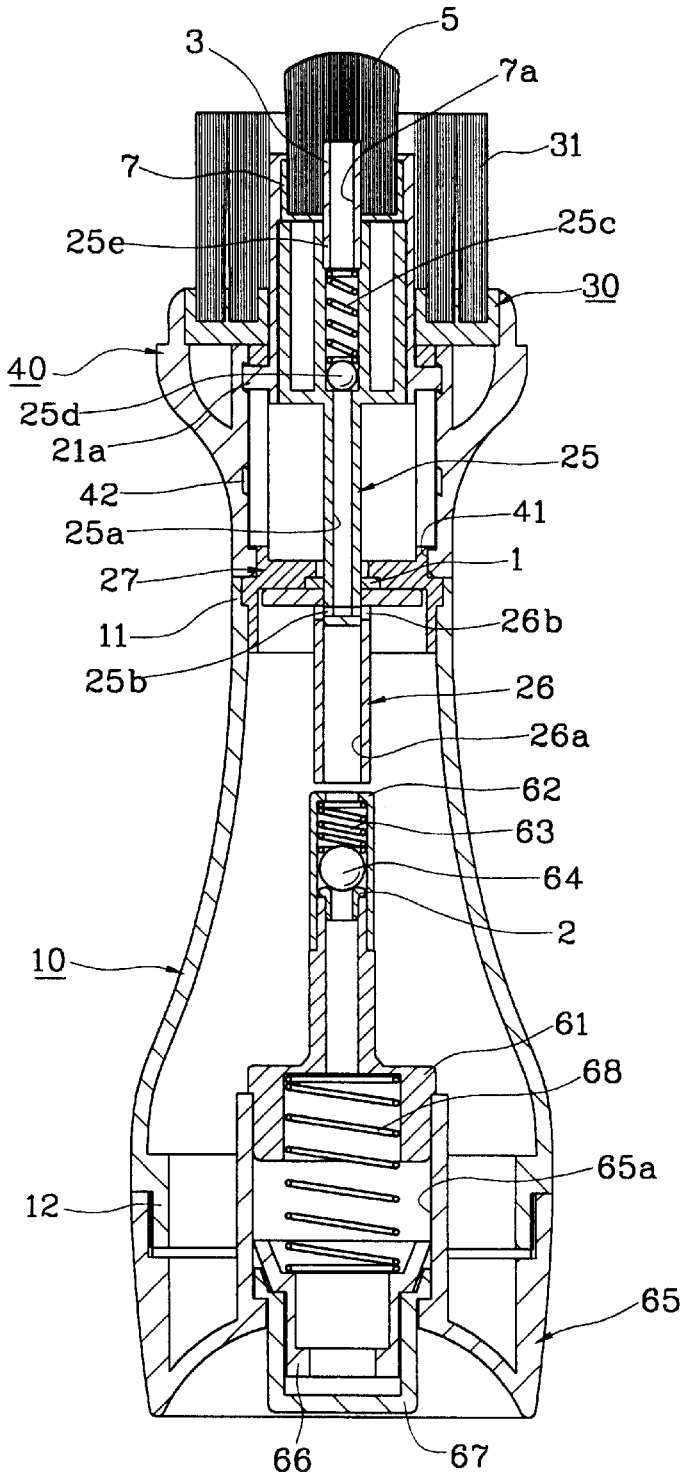
FIG. 5 is a sectional view illustrating another embodiment of the ejecting valve in FIG. 2.
Figure 6:
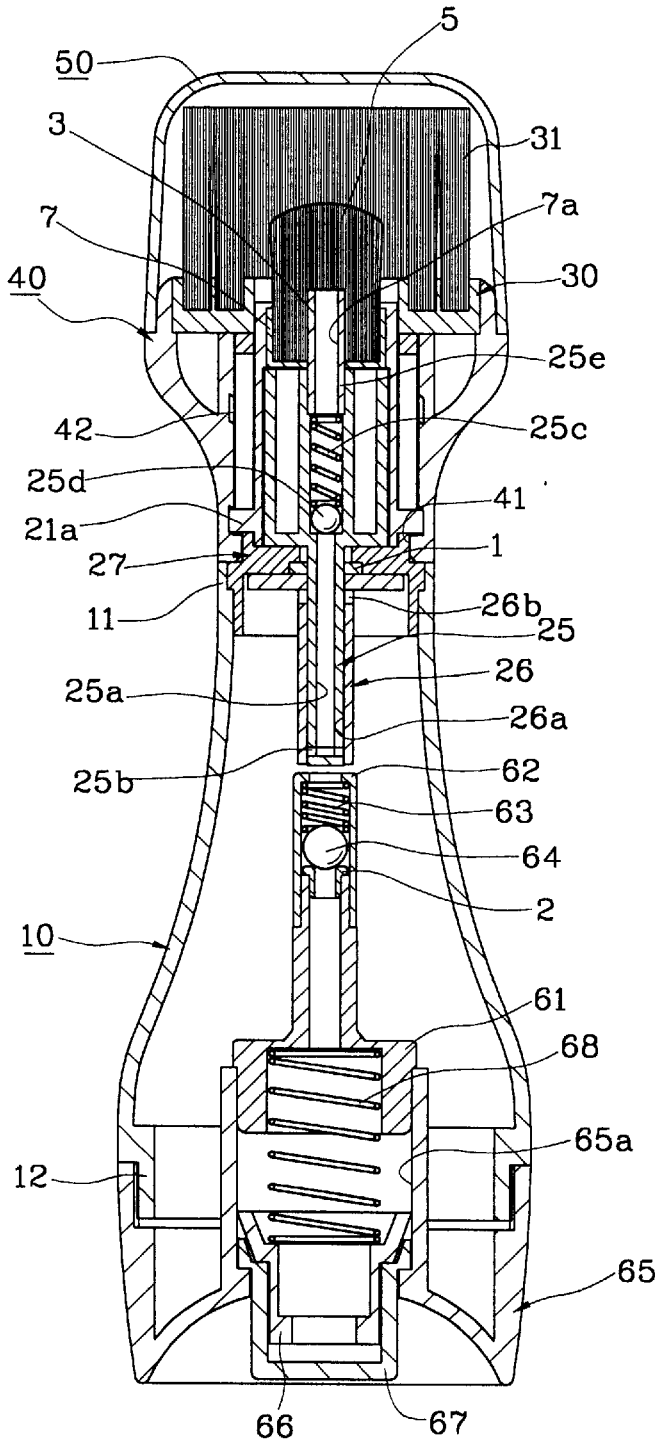
FIG. 6 is a sectional view illustrating another embodiment of the ejecting valve in FIG. 3.

FIG. 5 is a sectional view illustrating another embodiment of the ejecting valve in FIG. 2 and FIG. 6 is a sectional view illustrating another embodiment of the ejecting valve in FIG. 3.

On the other hand, FIGS. 5 and 6 show another embodiments of the ejecting valves in FIGS. 2 and 3. In this embodiment of the present invention, the foundation is ejected not by the rotation of the ball 22 of the sleeve 21 but an ejecting brush 5 as shown in FIGS. 5 and 6.

This provides a softer feeling on the skin when compared with the ball 22. And, an explanation of the components different from those in FIGS. 2 and 3 will be given for the sake of brevity.

As noted above, the ejection of the foundation which is finally caused from the rotation of the ball 22 is carried out through the ball 22, the support part 23 and the spring 24 in the sleeve 21. Therefore, in another embodiment of the present invention they are removed and instead, the ejecting brush 5 and an ejecting brush holder 7 are provided.

The ejecting brush 5 is a bundle of soft fiber, with which the ball 22 is replaced. The ejecting brush 5 comes in close contact with the one side of the sleeve 21 and secured.

The ejecting brush holder 7 is adapted to render the ejecting brush 5 come in close contact with the one side of the sleeve 21 and secure it thereon. Also, the ejecting brush holder 7 forms a hole 7*a* through which the foundation is ejected, on the center thereof.

Additionally, a spring holder 3 supporting the spring 25*c* is extended toward the ejecting brush 5, such that the foundation is induced to the ejecting brush 5, without any leakage to an extra space.

In FIGS. 5 and 6, the legend, the hole 7*a* of the ejecting brush holder 7 is indicated on the pipe path penetrated of the spring holder 3, which is caused by the limitation of the drawing with a restricted size. Since the spring holder 3 is passed through the hole 7*a* and extended toward the ejecting brush 5 in the drawing, the legend of the hole 7*a* is indicated on the pipe path penetrated of the spring holder 3, for the convenience of drawing.

Figure 7:
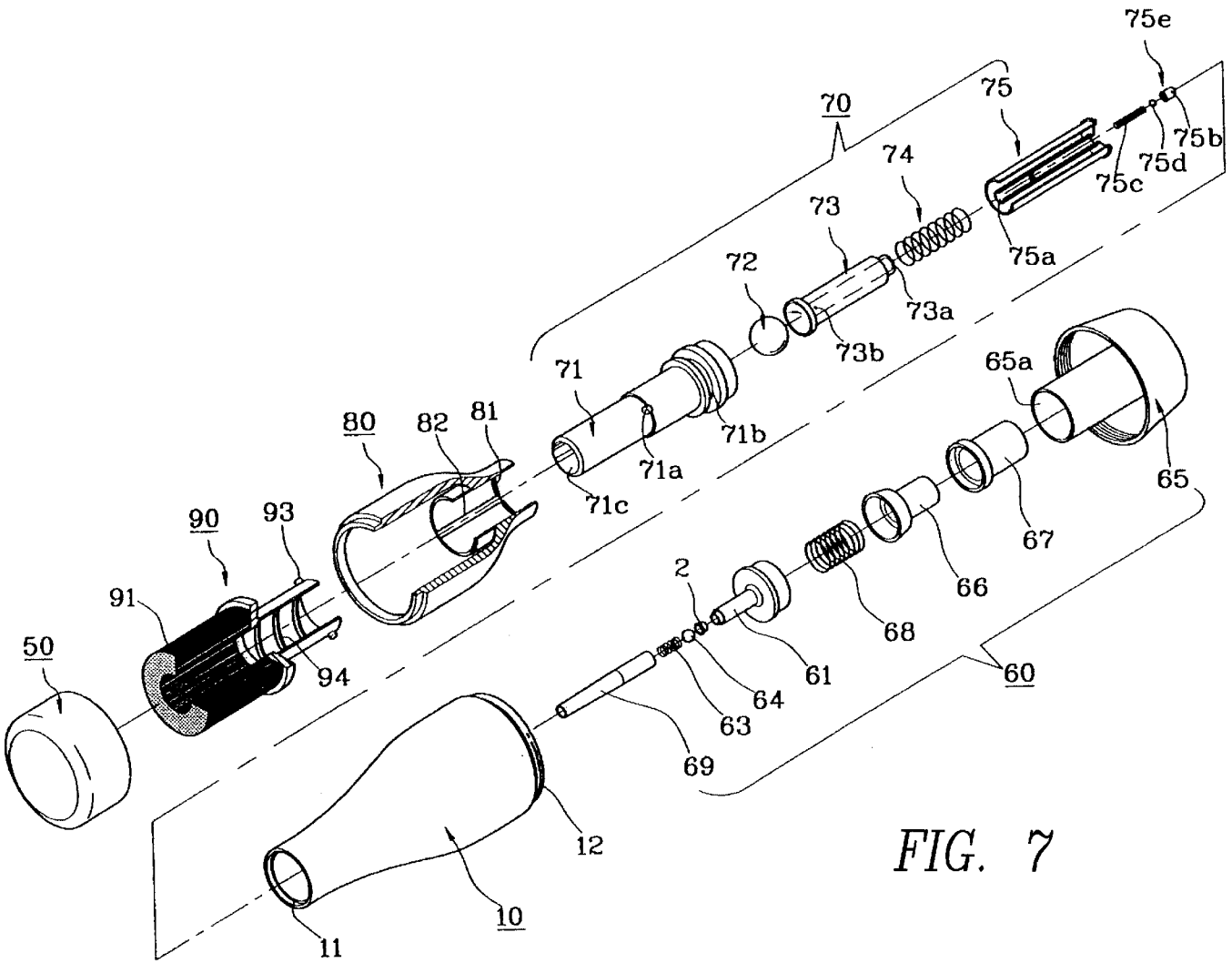
FIG. 7 is an exploded perspective view partly cut away of a second embodiment of the foundation-retained cosmetic implement of the present invention.
Figure 8:
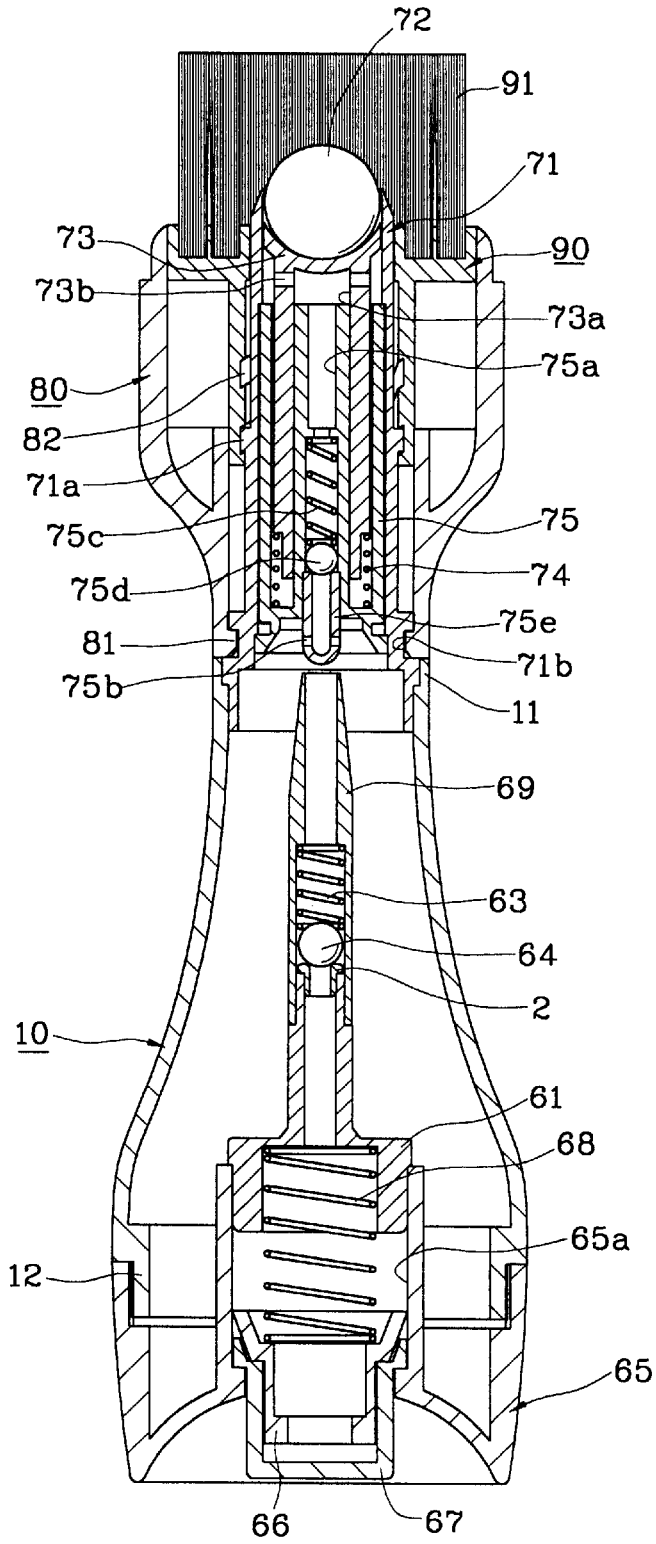
FIG. 8 is a sectional view illustrating the state where a holder is descended in FIG. 7.
Figure 9:
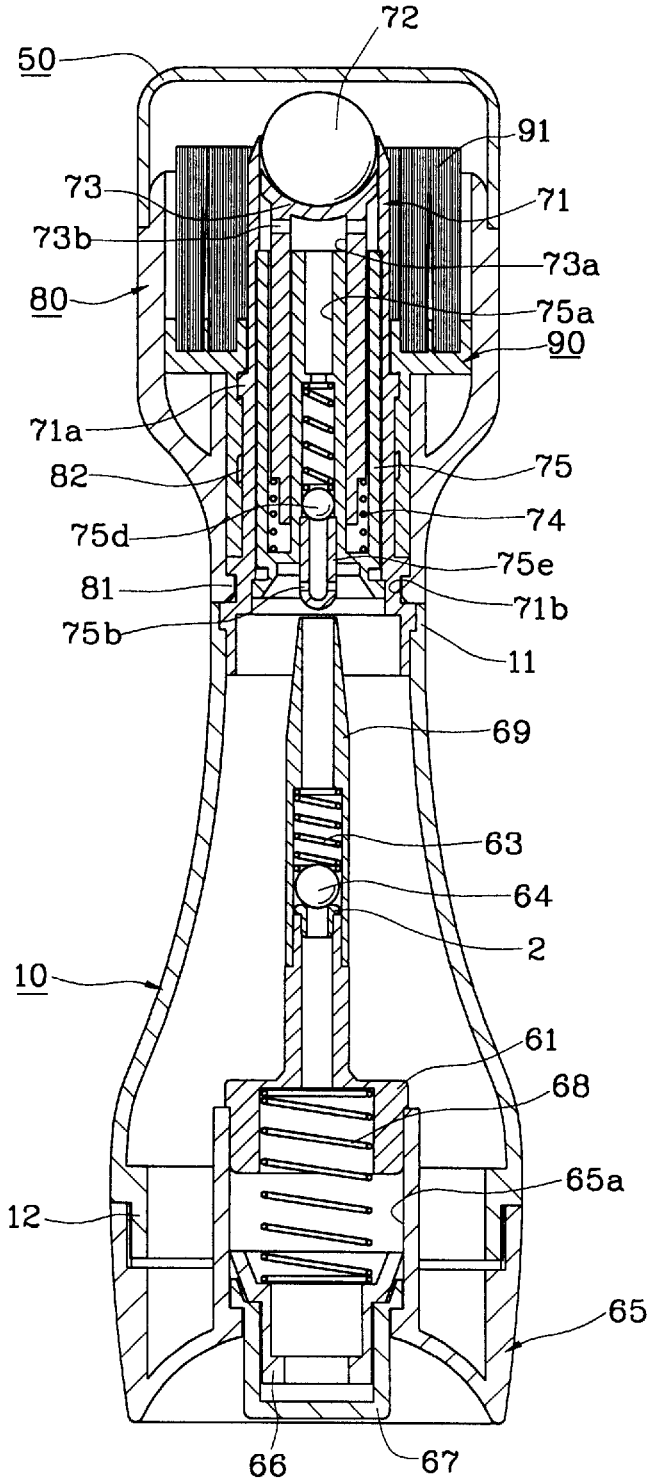
FIG. 9 is a sectional view illustrating the state where a holder is ascended in FIG. 7.

FIG. 7 is an exploded perspective view partly cut away of a second embodiment of the foundation-retained cosmetic implement of the present invention, FIG. 8 is a sectional view illustrating the state where a holder is descended in FIG. 7, and FIG. 9 is a sectional view illustrating the state where a holder is ascended in FIG. 7.

According to the second embodiment of the present invention, the foundation-retained retained cosmetic implement, in which an ejecting valve 70 is secured at a predetermined position and a holder 90 with foundation make-up means is ascendably or descendably driven, includes the body 10 in which the foundation is retained, the ejecting valve 70 fixedly disposed on an upper portion 11 of the body 10, an ascending and descending guide part 80 rotatably provided on the upper portion 11 of the body 10, the holder 90 ascendably and descendably driven by the guide of the ascending and descending guide part 80, a protecting cap 50 for protecting the foundation paining equipment provided on the holder 90 from the outside, and the pressurization pump 60 for injecting the foundation retained in the body 10 to the ejecting valve 70.

The construction of the body 10, the protecting cap 50 and the pressurization pump 60 of the whole components of the cosmetic implement according to the second embodiment of the present invention is the same as in the first embodiment of the present invention and an explanation of them will be excluded for the sake of brevity. However, the pressurization pump 60 has the air tube 69 somewhat longer than that in the first embodiment of the present invention.

On the other hand, the ejecting valve 70, the ascending and descending guide part 80 and the holder 90 in the second embodiment of the present invention have the following differences from those in the first embodiment of the present invention.

The ejecting valve 70 in the second embodiment is the same as in the first embodiment in its functional respect. That is, the ejecting valve 70 serves to adjust an amount of foundation retained in the body 10 to eject the adjusted amount of foundation to the outside.

However, the ejecting valve 70 in the second embodiment is different from that in the first embodiment in its structural respect. That is, a sleeve 71 is secured to the upper portion of the body 10, and the movable valve pipe 25 in the first embodiment is not adopted in the second embodiment of the present invention.

The sleeve 71 which is fixedly coupled to the upper portion of the body 10 in a forced pressurization manner forms a protrusion 71*a* that is engaged with a spiral groove 94 as will be discussed later and a coupling groove 71*b* that is engaged with a coupling projection 81 on the outer periphery thereof and forms a pipe path 71*c* penetrating the both sides thereof through which the foundation is passed on the center thereof.

A ball 72, a support part 73 and a spring 74 are inserted into the pipe path 71*c* of the sleeve 71, which have the same construction and function as in the first embodiment of the present invention.

On the other hand, a fixed valve pipe 75 is inserted into the pipe path 71*c* of the sleeve 71 and forms a pipe path 75*a* penetrating the one side thereof that communicates with the pipe path 73*a* of the support part 73 on the center thereof.

At this time, the fixed valve pipe 75 interposes a switch part 75*d* and a spring 75*c* that have the same function as the switch part 25*d* and the spring 25*c* of the movable valve pipe 25 in the first embodiment, such that the foundation can be ejected only in one direction. The switch part 75*d* and the spring 75*c* may be inserted into the fixed valve pipe 75 by a spring holder 75*e* and in the drawing, a hole 75*b* of the fixed valve pipe 75 is formed on the spring holder 75*e*. However, if it is assumed that the fixed valve pipe 75 and the spring holder 75*e* are formed as an integral body with each other, the hole 75*b* may be formed on the outer peripheral surface of the fixed valve pipe 75. In the preferred embodiment of the present invention, the hole 75*b* of the fixed valve pipe 75 indicates the hole 75*e* formed on the spring holder 75*e*.

As a result, the foundation retained in the body 10 reaches the position of the ball 72, via the hole 75*b* and pipe path 75*a* of the fixed valve pipe 75 and the pipe path 73*a* and hole 73*b* of the support part 73, at a starting point of the body 10.

On the other hand, the ascending and descending guide part 80 is provided with a coupling projection 81 with which the coupling groove 71*b* of the sleeve 71 is engaged, such that it is rotatable to the outside of the sleeve 71 secured to the upper portion 11 of the body 10. Also, the ascending and descending guide part 90 is provided with an ascending and descending groove 82 into which an ascending and descending projection 93 of the holder 90 as will be discussed later is inserted.

The holder 90 is not secured to the ascending and descending guide part 80 unlike the first embodiment of the present invention but is ascendable and descendable on the upper portion 11 of the body 10 in repeated manner. In more detail, the holder 90 is extended on the one side thereof, on which the ascending and descending projection 93 that is engaged with the ascending and descending groove 82 of the ascending and descending guide part 80 and a spiral groove 94 that is engaged with the protrusion 71*a* of the sleeve 71 are formed.

As a consequence, the holder 90 receives the guide for the ascending and descending direction by the ascending and descending projection 93 that is engaged with the ascending and descending groove 82 of the ascending and descending guide part 80 and at the same time, if the ascending and descending guide part 80 rotates by the external force, the holder 90 is ascended and descended by the spiral groove 94 that is engaged with the protrusion 71*a* of the sleeve 71.

Figure 10:
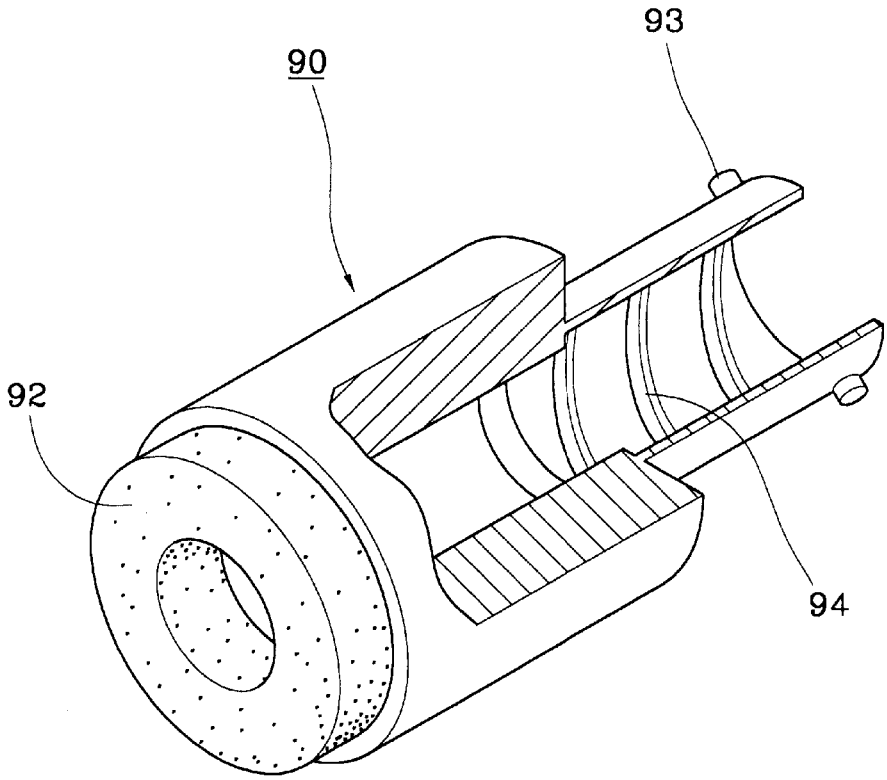
FIG. 10 is a perspective view illustrating another embodiment of the holder in FIG. 7.

The foundation make-up means provided on the holder 90 is a brush 91 made of a bundle of soft fiber as shown in FIG. 7 or sponge 92 as shown in FIG. 10.

According to the second embodiment of the present invention, the holder 90 can be ascended and descended relative to the ball 72 of the ejecting valve 70 by the application of the external rotating force to the ascending and descending guide part 80. Upon make-up with the foundation, therefore, the ascending and descending guide part 80 is rotated to descend the holder 90 up to the bottom and then, the ball 72 rolls on the skin to be painted, such that the foundation is ejected on the corresponding skin. When an appropriate amount of foundation is ejected, the ascending and descending guide part 80 is rotated with reverse motion to ascend the holder 90 up to the top and subsequent to this, the foundation is evenly covered with the skin by using the foundation make-up means (91 or 92) provided on the holder 90.

Figure 11:
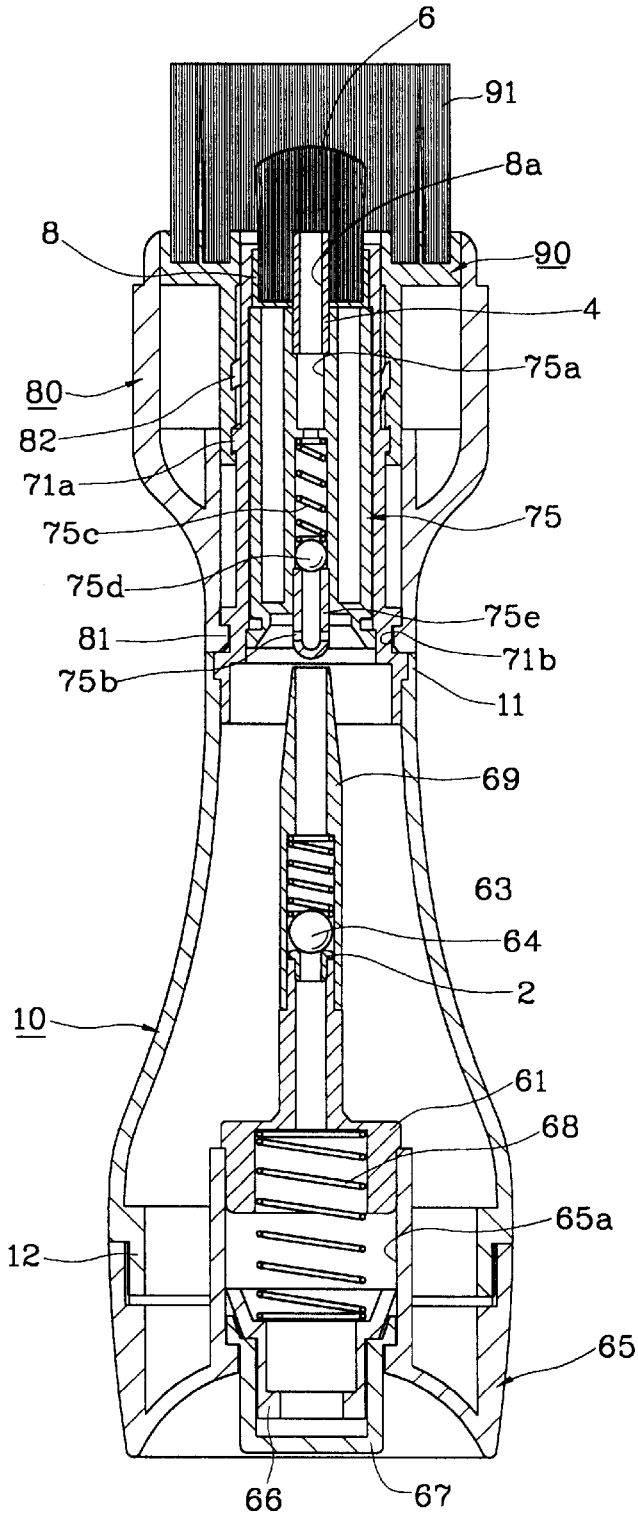
FIG. 11 is a sectional view illustrating another embodiment of the ejecting valve in FIG. 8.
Figure 12:
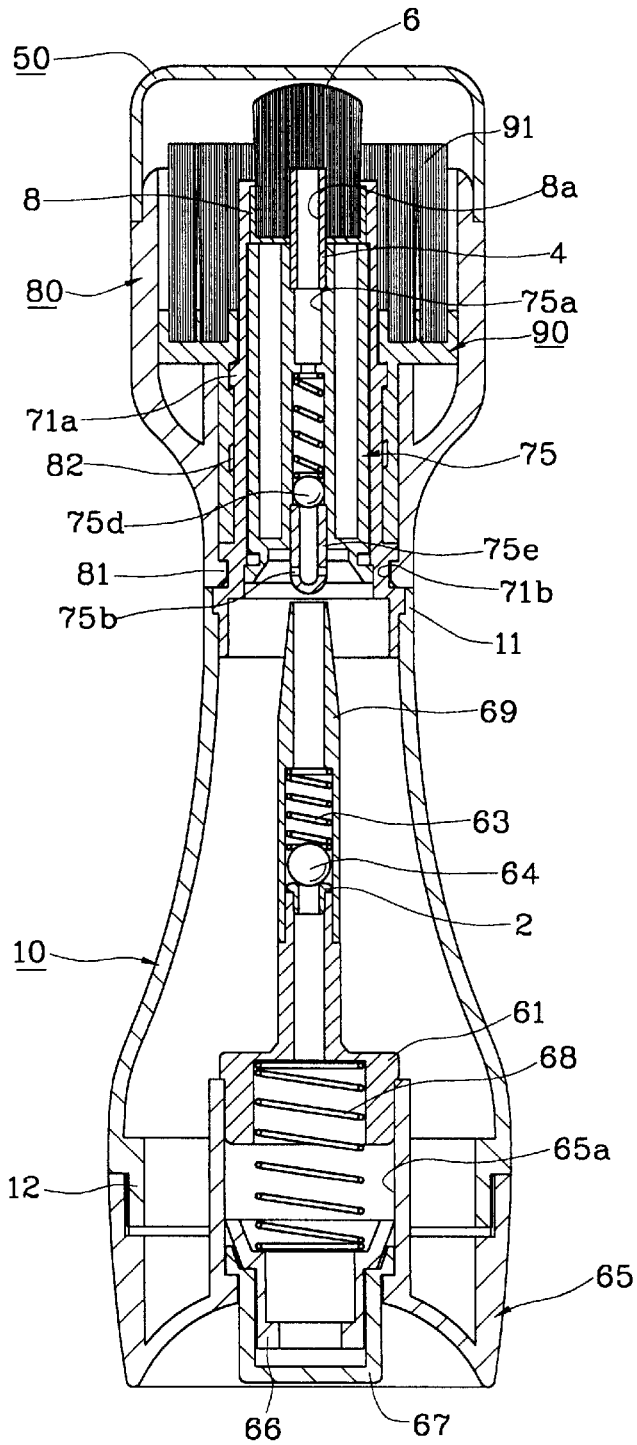
FIG. 12 is a sectional view illustrating another embodiment of the ejecting valve in FIG. 9.

FIG. 11 is a sectional view illustrating another embodiment of the ejecting valve in FIG. 8, and FIG. 12 is a sectional view illustrating another embodiment of the ejecting valve in FIG. 9.

On the other hand, FIGS. 11 and 12 show another embodiments of the ejecting valves in FIGS. 8 and 9. In this embodiment of the present invention, the foundation is ejected not by the rotation of the ball 72 of the sleeve 71 but by an ejecting brush 6, as shown in FIGS. 11 and 12.

The ejecting brush provides a softer feeling on the skin when compared with the ball 72, and since it is similar to that in FIGS. 5 and 6, an explanation of it will be excluded in this detailed description for the sake of brevity.

In the same manner as in the first embodiment of the present invention, the ejection of the foundation that is finally caused not by the ball 72, the support part 73 and the spring 74 in the sleeve 71 but by the ejecting brush 6 and the ejecting brush holder 8. Therefore, in another embodiment of the present invention they are replaced by the ejecting brush 6 and the ejecting brush holder 7. Therefore, the foundation can be ejected with the soft feeling of the ejecting brush 6.

An ejecting pipe 4 as an additional component is adapted to induce the foundation that has been passed through the fixed valve pipe 75 to the ejecting brush 6, without any leakage to an extra space. And, an explanation of the components as discussed in the first embodiment of the present invention will be avoided for the sake of brevity.

Reference numerals 1 and 2 that are not omitted in the above description denote packing.

As discussed above, a foundation-retained cosmetic implement according to the present invention is constructed in such a manner that a holder and an ejecting valve are ascendably and descendably provided on the upper portion of the body retaining the foundation, relatively to each other, through an ascending and descending guide part, whereby the foundation can be kept and carried in an extremely simple manner without requiring a separate cosmetic implement. In addition, a foundation-retained cosmetic implement according to the present invention is capable of adjusting an amount of foundation ejected in accordance with the cooperative action of the ejecting valve and the pressurization pump, whereby an unnecessary consumption of the foundation can be prevented.

While the present invention has been described with reference to a few specific embodiments, the description is illustrative of the invention and is not to be construed as limiting the invention. Various modifications may occur to those skilled in the art without departing from the spirit and scope of the invention as defined by the appended claims.

What is claimed is:

1. A foundation-retained cosmetic implement comprising:

a) a body penetrated from the bottom to the top thereof and providing a foundation-receiving space therein;

b) an ejecting valve provided on an upper portion of said body and for adjusting an amount of foundation retained in said body for ejection and then ejecting said amount of foundation to the outside;

c) said ejecting valve is ascendably and descendably disposed on said upper portion of said body;

d) a holder provided in parallel to said ejecting valve on said upper portion of said body and having foundation make-up means;

e) an ascending and descending guide part for coupling said ejecting valve and said holder with said upper portion of said body in order to ascend and descend said ejecting valve and said holder relatively to each other;

f) said ascending and descending guide part is adapted to surround said outer periphery of said ejecting valve and is rotatably disposed on said upper portion of said body, such that said ejecting valve is ascended and descended as said ascending and descending guide part is forced to rotate with forward and return motion, and said holder is fixedly disposed on the one side of said ascending and descending guide part;

g) a protecting cap attachably and detachably coupled with said upper portion of said ascending and descending guide part for protecting said foundation make-up means from the outside; and h) a pressurization pump coupled with a lower portion of said body and carrying out an air pumping for injecting the foundation retained in said body to said ejecting valve.

2. The foundation-retained cosmetic implement according to claim 1, wherein the ejecting valve comprises:

a sleeve forming a protrusion on the outer periphery thereof and a pipe path passed through both sides through which the foundation is passed on the center thereof;

a ball adapted to be inserted into the pipe of the sleeve and being rotated, while being contacted into the one side of the sleeve;

a support part adapted to be inserted into the pipe path of the sleeve for supporting the ball on the one side thereof;

a pipe path passing through one side of said support part that communicates with the pipe path of said sleeve on the center thereof and a hole communicating with the pipe path thereof on the outer periphery thereof;

a spring positioned on the one side of the support part and interposed in the pipe path of said sleeve;

a movable valve pipe disposed on the one side of the spring to be inserted into the pipe path of the sleeve and forming a pipe path passed through one side that communicates with the pipe path of the support part through the hole of the support part on the center thereof and a hole communicating with the pipe path thereof on the outer periphery thereof;

a fixed valve pipe disposed on the one side of the movable valve pipe and forming a pipe path passed through one side that communicates with the pipe path of the movable valve pipe through the hole of the movable valve pipe on the center thereof and a hole communicating with the pipe path thereof on the outer periphery thereof, thereby functioning to finally communicate between the body and the sleeve;

a valve coupler for coupling the fixed calve pipe to the upper portion of the body and forming a coupling groove;

an ascending and descending groove on the outer peripheral surface thereof, the ascending and descending groove into which the protrusion of the sleeve is inserted, such that an ascending and descending driving direction is guided for the sleeve, the ascending and descending guide part is provided with a coupling projection that is engaged with the coupling groove, with a result to rotate on the outer side of the valve coupler and with a spiral groove into which the protrusion of the sleeve is inserted, with a result that the sleeve receives the ascending and descending driving force through the protrusion; and the holder is provided on the one side of the ascending and descending guide part and being passed on the center thereof, through which the sleeve is ascendable and descendable.

3. The foundation-retained cosmetic implement according to claim 1, wherein the ejecting valve further comprises:

a sleeve forming a protrusion on the outer periphery thereof and a pipe path penetrating the both sides thereof which the foundation is passed on the center thereof;

an ejecting brush adapted to be inserted into the pipe path of the sleeve for supporting the ejecting brush on the one side thereof and forming a hole communicating with the pipe path of the sleeve on the center thereof;

a movable valve pipe disposed on the one side of the ejecting brush holder to be inserted into the pipe path of the sleeve and forming a pipe path penetrating the one side thereof that communicates with the hole of the ejecting brush holder on the center thereof;

a fixed valve pipe disposed on the one side of the movable valve pipe and forming a pipe path penetrating the one side thereof that communicates with the pipe path of the movable valve pipe through the hole of the movable valve pipe on the center thereof and a hole communicating with the pipe path thereof on the outer periphery thereof, thereby functioning to finally communicate between the body and the sleeve;

a valve coupler for coupling the fixed valve pipe to the upper portion of the body and forming a coupling groove;

an ascending and descending groove on the outer peripheral surface thereof, the ascending and descending groove into which the protrusion of the sleeve is inserted, such that an ascending and descending driving direction is guided for the sleeve, the ascending and descending guide part is provided with a coupling projection that is engaged with the coupling groove, with a result that it rotates on the outer side of the valve coupler and with a spiral groove into which the protrusion of the sleeve is inserted, with a result that the sleeve receives the ascending and descending driving force through the protrusion; and the holder is provided on the one side of the ascending and descending guide part and penetrates the center thereof, through which the sleeve is ascendable and descendable.

4. The foundation-retained cosmetic implement according to claim 2, wherein the movable valve pipe interposes the spring and a switch part in the pipe path thereof, in order to eject the foundation only in one direction.

5. The foundation-retained cosmetic implement according to claim 1, wherein the ejecting valve is secured to the upper portion of the body, the holder is disposed in manner to be ascendable and descendable on the upper portion of the body, and the ascending and descending guide part is provided in manner to surround the outer periphery of the holder and rotate on the upper portion of the body, with a consequence that the holder is ascended and descended, as it rotates with forward and return motion.

6. The foundation-retained cosmetic implement according to claim 5, wherein the ejecting valve comprises:

a sleeve forming a protrusion and a coupling groove on the outer periphery thereof and a pipe path penetrating the both sides thereof through which the foundation is passed on the center thereof and coupled to the upper portion of the body;

a ball adapted to be inserted into the pipe path of the sleeve and secured, while being contacted with the one side of the sleeve;

a support part adapted to be inserted into the pipe path of the sleeve for supporting the ball on the one side thereof and forming a pipe path penetrating the one side thereof that communicates with the pipe path of the sleeve on the center thereof and a hole communicating with the pipe path thereof on the outer periphery thereof;

a spring disposed on the one side of the holder and interposed in the pipe path of the sleeve;

a fixed valve pipe disposed on the one side of the spring to be inserted into the pipe path of the sleeve and forming a pipe path penetrating the one side thereof that communicates with the pipe path of the support part through the hole of the support part on the center thereof and a hole communicating with the pipe path thereof on the outer periphery thereof, thereby functioning to finally communicate between the body and the sleeve;

the holder is extended on the one side thereof, penetrates the center thereof, forms an ascending and descending projection on the outer periphery thereof and forms a spiral groove into which the protrusion is inserted on the inner periphery thereof, such that the holder receives its ascending and descending driving force from the protrusion; and the ascending and descending guide part is provided with a coupling projection that is engaged with the coupling groove, with a result that it rotates on the outer side of the sleeve and with an ascending and descending groove into which the ascending and descending projection of the holder is inserted, with a result that an ascending and descending driving direction is guided onto the holder.

7. The foundation-retained cosmetic implement according to claim 5, wherein the ejecting valve comprises:

a sleeve forming a protrusion on the outer periphery thereof and a pipe path penetrating the both sides thereof through which the foundation is passed on the center thereof and coupled to the upper portion of the body;

an ejecting brush adapted to be inserted into the pipe path of the sleeve and secured, while being contacted with the one side of the sleeve;

an ejecting brush holder adapted to be inserted into the pipe path of the sleeve for supporting the ejecting brush on the one side thereof and forming a hole communicating with the pipe path of the sleeve on the center thereof;

a fixed valve pipe disposed on the one side of the ejecting brush holder to be inserted into the pipe path of the sleeve and forming a pipe path penetrating the one side thereof that communicates with the hole of the ejecting brush holder on the center thereof and a hole communicating with the pipe path thereof on the outer periphery thereof, thereby functioning to finally communicate between the body and the sleeve;

the holder is extended on the one side thereof, penetrates the center thereof, forms an ascending and descending projection on the outer periphery thereof and forms a spiral groove into which the protrusion is inserted on the inner periphery thereof, such that the holder receives its ascending and descending driving force from the protrusion; and the ascending and descending guide part is provided with a coupling projection that is engaged with the coupling groove, with a result that it rotates on the outer side of the sleeve and with an ascending and descending groove into which the ascending and descending projection of the holder is inserted, with a result that an ascending and descending driving direction is guided onto the holder.

8. The foundation-retained cosmetic implement according to claim 6, wherein the fixed valve pipe interposes a spring and a switch part in the pipe path thereof, in order to eject the foundation only in one direction.

9. The foundation-retained cosmetic implement according to claim 1, wherein the pressurization valve comprises:

an air valve pipe providing a path through which air passes;

an air tube coupled to the one end of the air valve pipe for guiding an air pouring direction to the ejecting valve;

a spring interposed in the center of the air tube;

a switch part inserted in the center of the air tube and for injecting air in one direction by virtue of an elastic force of the spring;

a rear cap coupled to the other end of the air valve pipe and forming a closed space on the center thereof;

a compressive part for reciprocating movement in the closed space of the rear cap to pour the compressed air to the air valve pipe;

a button coupled to the compressive part and exposed to the outside through the rear cap on the one side thereof to apply a reciprocating driving force to the compressive part by an external power; and a spring interposed between the air valve pipe and the compressive part for providing a restoring strength in one direction to the compressive part.

10. The foundation-retained cosmetic implement according to claim 1, wherein the foundation make-up means is a brush.

11. The foundation-retained cosmetic implement according to claim 1, wherein the foundation make-up means is sponge.

12. The foundation-retained cosmetic implement according to claim 3, wherein the movable valve pipe interposes the spring and a switch part in the pipe path thereof, in order to eject the foundation only in one direction.

13. The foundation-retained cosmetic implement according to claim 7, wherein the fixed valve pipe interposes a spring and a switch part in the pipe path thereof, in order to eject the foundation only in one direction.

* * * * *